US006297710B1

(12) United States Patent
Cook et al.

(10) Patent No.: US 6,297,710 B1
(45) Date of Patent: Oct. 2, 2001

(54) SLIP JOINT POLARIZER

(75) Inventors: Scott J. Cook; Dennis L. Cronin, both of Garner; Peter L. Gardner, Apex; John Michael Vezmar, Garner, all of NC (US)

(73) Assignee: Channel Master LLC, Smithfield, NC (US)

( * ) Notice: Subject to any disclaimer, the term of this patent is extended or adjusted under 35 U.S.C. 154(b) by 0 days.

(21) Appl. No.: 09/388,595

(22) Filed: Sep. 2, 1999

(51) Int. Cl.[7] ..... H01P 1/16; H01Q 19/00
(52) U.S. Cl. ..... 333/21 A; 343/756
(58) Field of Search ..... 333/26, 21 A, 333/21 R, 1; 343/756

(56) References Cited

U.S. PATENT DOCUMENTS

| | | | | |
|---|---|---|---|---|
| 3,287,730 | | 11/1966 | Kerr | 343/756 |
| 3,665,481 | | 5/1972 | Low et al. | 343/762 |
| 3,681,714 | * | 8/1972 | Terakawa | 333/21 R |
| 3,731,236 | | 5/1973 | Di Tullio et al. | 333/9 |
| 3,924,205 | | 12/1975 | Hansen et al. | 333/21 |
| 3,938,157 | | 2/1976 | Brickey | 343/756 |
| 4,178,574 | | 12/1979 | Edens et al. | 343/756 |
| 4,222,017 | | 9/1980 | Foldes | 333/122 |
| 4,311,973 | | 1/1982 | Nuding et al. | 333/33 |
| 4,353,041 | | 10/1982 | Bryans et al. | 333/21 |
| 4,375,052 | | 2/1983 | Anderson | 333/21 |
| 4,387,378 | | 6/1983 | Henderson | 333/854 |
| 4,546,359 | | 10/1985 | Bui-Hai | 343/781 |
| 4,565,346 | | 1/1986 | Edwards | 248/588 |
| 4,663,634 | | 5/1987 | Fulton | 343/756 |
| 4,679,009 | | 7/1987 | Cloutier | 333/21 |
| 4,748,451 | | 5/1988 | Edwards | 343/880 |
| 4,829,313 | | 5/1989 | Taggart | 343/756 |
| 4,903,037 | | 2/1990 | Mitchell et al. | 343/756 |
| 5,162,808 | | 11/1992 | Kim | 343/786 |
| 5,463,358 | * | 10/1995 | Dunn et al. | 333/1 |
| 5,576,668 | | 11/1996 | Clark et al. | 333/21 |

* cited by examiner

*Primary Examiner*—Robert Pascal
*Assistant Examiner*—Kimberly E. Glenn
(74) *Attorney, Agent, or Firm*—Darby & Darby

(57) ABSTRACT

A slip joint polarizer including a stationary waveguide rotatably connected to a moveable waveguide, e.g. an ortho mode transducer, by a mating interface, such as a pair of rotatable mating flanges. The moveable waveguide is rotatable with respect to the stationary waveguide to adjust at least one of receive and transmit polarity. A probe extends axially in the moveable waveguide, passing through the mating interface and into the stationary waveguide. The probe may be attached to the moveable waveguide so that the two rotate simultaneously. Alternatively, the probe may rotate independent of the moveable waveguide to adjust for transmit polarity. During installation, the moveable waveguide is rotated with respect to the stationary waveguide in order to adjust receive and/or transmit polarity. Once properly adjusted, the rotatable mating flanges are locked together to prevent movement.

29 Claims, 2 Drawing Sheets

SLIP JOINT POLARIZER

BACKGROUND OF THE INVENTION

1. Field of the Invention

The present invention relates to an antenna system, and in particular to a slip joint polarizer integrated into an antenna reflector system.

2. Description of Related Art

Recently, Very Small Aperture Terminal (VSAT) antenna systems are coming into widespread use in private communication systems. In such antenna systems a transmitter radio is fixedly connected via an ortho mode transducer (OMT) to a feed horn placed in front of a reflector. The antenna assembly including the transmitter radio, OMT, and feed horn is supported on the end of a boom. During installation the antenna assembly is rotated to adjust receive and/or transmit polarity of the side port and through port of the OMT based on the geographical site of the antenna relative to the satellite. Due to its relatively large size and weight, rotation of the antenna assembly is obtrusive and clumsy.

Instead of rotating the feed horn/OMT/transmitter radio assembly, some antenna systems rotate the entire reflector antenna system. In these antenna systems it is practical to rotate the entire antenna due to their relatively small size. Even so, such antenna systems require a relatively complex and expensive reflector back structure and a boom/feed support system that is able to withstand gravitational loads in many orientations.

Channel Master, the assignee of the present invention, has developed a probe polarizer in which a probe and its dielectric holder rotate while the feed horn, OMT and transmitter radio remain stationary. This construction, however, is very sensitive to manufacturing variations and requires a special fixture to set the proper angle of the probe. In addition, the probe is only used to adjust transmit polarity and has no effect on receive polarity.

It is therefore desirable to develop a relatively simple and inexpensive connection means for adjusting receive and/or transmit polarity of a linear polarity transmit/receive system that overcomes these problems.

SUMMARY OF THE INVENTION

The present invention is directed to a slip joint polarizer and a method for installing the same. In accordance with the invention, the slip joint polarizer includes a stationary waveguide rotatably connected to a moveable waveguide by a mating interface, such as a pair of rotatable mating flanges. The moveable waveguide is rotated with respect to said stationary waveguide to adjust receive and/or transmit polarity. A probe extends axially in said moveable waveguide, passing through said mating interface and into said stationary waveguide. The probe may be attached to the moveable waveguide so that the two rotate simultaneously. Alternatively, the probe may be rotatable independent of the moveable waveguide to adjust for transmit polarity. During installation, the moveable waveguide is rotated with respect to the stationary waveguide in order to adjust receive and/or transmit polarity. Once properly adjusted, the rotatable mating flanges arc locked together to prevent movement.

BRIEF DESCRIPTION OF THE DRAWING

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE INVENTION

Figure 1:
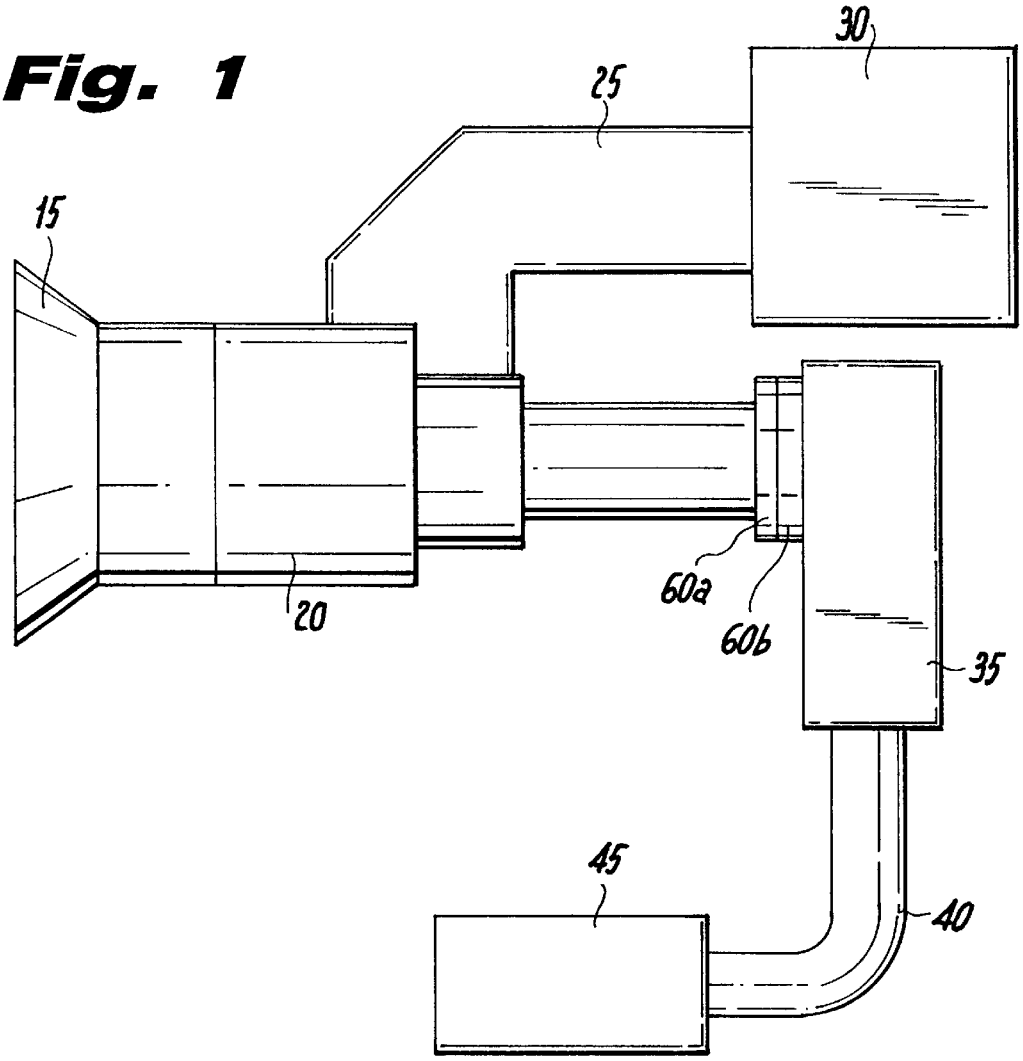
FIG. 1 is an example side view of a slip joint polarizer in accordance with the present invention.

FIG. 1 is a side view of an example slip joint polarizer in accordance with the present invention for a linear polarity transmit/receive system, such as an antenna system. The example antenna system shown in FIG. 1 includes a feed horn 15 connected to a common port of an ortho mode transducer (OMT) 20, which supports signals having two orthogonal modes. A side port of the OMT is connected to a filter elbow 25, which, in turn, is connected to a low noise block (LNB) 30, while a through port of the OMT is connected, by way of a rotatable mating interface 60*a*, 60*b*, to a top or broad wall of a rectangular waveguide 35. Although the filter elbow 25 is shown in FIG. 1 as a separate device it may be integrated into the LNB 30. Furthermore, a feed elbow without a filter may be used instead of the filter elbow 25. In the embodiment shown in FIG. 1, the through port of the OMT and the waveguide 35 have a circular and a rectangular cross section, respectively, however, any shape may be used as desired. Preferably, the OMT 20 and waveguide 35 are oriented substantially perpendicular to one another so as to reduce the overall size of the antenna system. A swept bend 40 and transmitter radio 45, or any other stationary device, are connected in series to one end of the waveguide 35. The swept bend may be arranged at any desired angular orientation. Although not shown in FIG. 1, a filter may be disposed between waveguide 35 and transmitter radio 45.

Figure 2:
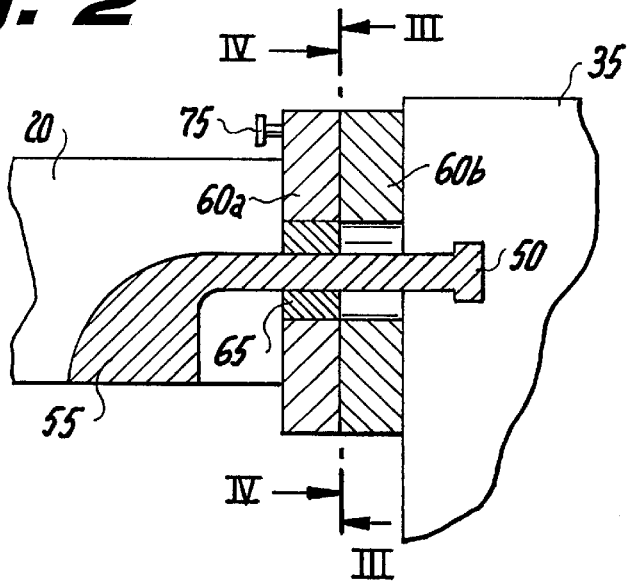
FIG. 2 is a partial cross-sectional view of a first embodiment of a probe fixedly attached to a ridge launch on the inner surface of an OMT in accordance with the present invention.

FIG. 2 is a partial cross-sectional view of a first embodiment of the arrangement of a probe 50 with respect to the mating interface 60*a*, 60*b* in accordance with the present invention. A fixed end of the probe 50 is screwed or pressed into a ridge launch 55 attached to the inner surface of the OMT 20 in order to excite the OMT. Alternatively, the probe 50 may be cast as part of the ridge launch 55. The probe 50 passes through the mating surfaces 60*a*, 60*b* and into the waveguide 35. Probe 50 may be supported between the mating interfaces by a dielectric 65, if additional support is necessary. Since the probe is secured to the inner surface of the OMT, the probe rotates simultaneously with the feed horn/OMT/filter elbow/LNB assembly to adjust the polarization of the side and through ports, while the waveguide/swept bend/transmitter radio assembly remains stationary.

Figure 5:
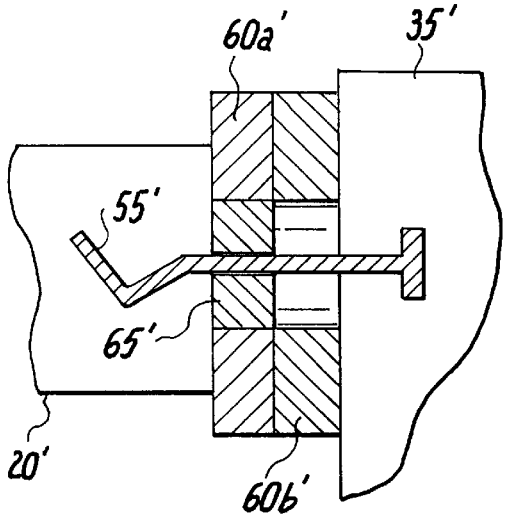
FIG. 5 is a partial cross-sectional view of a second embodiment of a probe fixedly attached by a dielectric to the OMT in accordance with the present invention.

In a second embodiment shown in FIG. 5, instead of providing a ridge launch in the OMT, the probe 55' may be bent to excite the OMT 20' directly. A dielectric 65' fixedly attaches the probe 55' to the OMT 20' to insure that the polarity of the side and through ports of the OMT are adjusted when the feed horn/OMT/filter elbow/LNB assembly is rotated.

Figure 6:
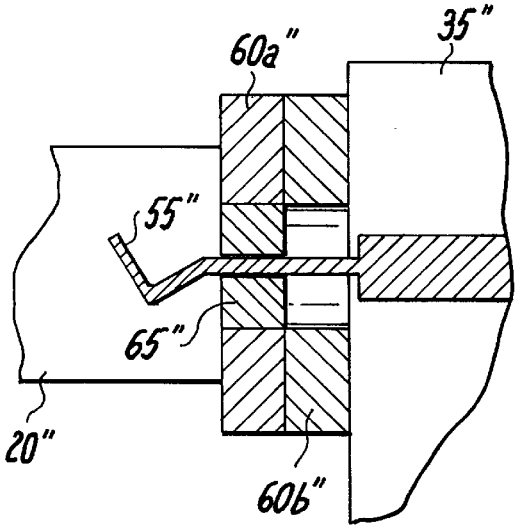
FIG. 6 is a partial cross-sectional view of a third embodiment of a probe fixedly attached by a dielectric to the OMT and waveguide in accordance with the present invention.

FIG. 6 shows a third embodiment in which the probe's rotation may be independent of rotation of the feed horn/OMT/filter elbow/LNB assembly. The probe 55" is held in place through the mating flanges 60*a*", 60*b*" by a dielectric 65" and extends beyond the opposite top wall of the waveguide 35 so as to be accessible from outside for adjusting the transmit polarity. In this configuration, the feed horn/OMT/filter elbow/LNB assembly is also rotatable about the feed horn axis in order to adjust receive and/or transmit polarity of the side and through ports of the OMT.

Figure 3:
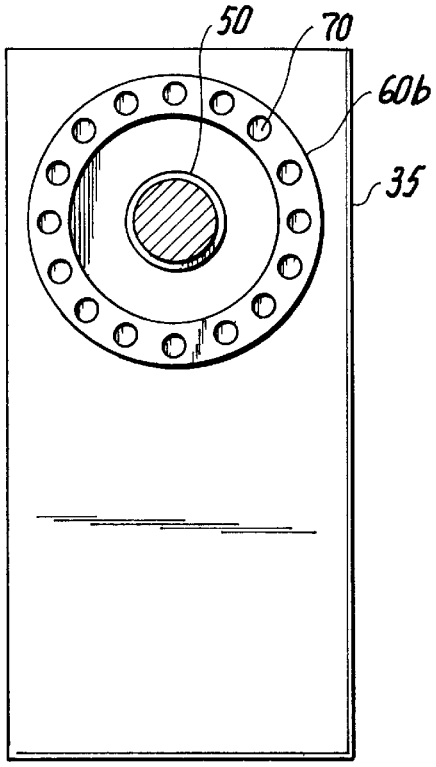
FIG. 3 is a view of the rectangular waveguide in FIG. 2 along line III—III.
Figure 4:
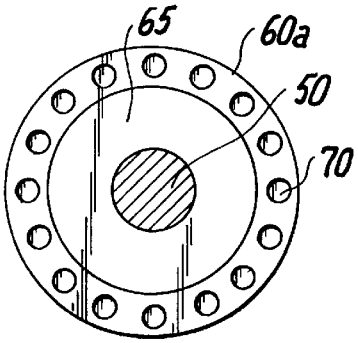
FIG. 4 is a view of the OMT in FIG. 2 along line IV—IV.

By way of example, as shown in FIGS. 1 and 2, the rotatable mating interface may include a first flange 60*a* attached to the through port of the OMT and a second flange defining the opening in the top wall of the waveguide 35. FIGS. 3 and 4 depict front views of the second flange 60*b* and first flange 60*a*, respectively, in FIG. 2, wherein each flange has defined therethrough a plurality of channels 70. A pin 75 or other locking member passes through a channel in both flanges to lock the flanges in position after having been properly adjusted. Rotatable mating flanges are advantageous in that they are relatively inexpensive to manufacture using well known casting techniques that do not require a high degree of precision. Other known rotatable mating interfaces or joints, however, may be used, such as precision nesting cylindrical members. Instead of a physical connection, chokes may alternatively be used as the mating interface between the OMT 20 and waveguide 35 to establish an electrical connection between the flanges.

During installation, the transmitter radio is mounted in place and the feed horn/OMT/ filter elbow/LNB assembly is rotated about the feed horn axis with respect to the stationary waveguide/swept bend/transmitter radio assembly via the mating interface until proper polarization is realized at the side and through ports. Then, the mating flanges 60*a*, 60*b* are locked in position, for example, by inserting one or more pins 75 through aligned channels 70 in both of the flanges. This polarization adjustment process need only be performed once at the time of installation.

In operation, a microwave signal is generated by the transmitter radio 45 passes through the swept bend 40 and into the waveguide 35. The free end of the probe 50 in the waveguide 35 picks up the transmitted signal and passes it through an aperture in the mating interface to the OMT's through port. Once in the OMT the signal is passed out through the feed horn.

Conversely, an orthogonal polarized signal is received by the feed horn and through the common port of the OMT supporting the two orthogonal modes. An interfering orthogonal signal at the same frequency may also be received by the OMT. The polarization of the signals are isolated by the OMT 20, whereby the desired polarity signal is channeled via the side port of the OMT 20 through the filter elbow 25 and into the LNB 30. On the other hand, the interfering signal is reflected back out of the device via the through port.

Although the slip joint polarizer in accordance with the present invention is shown and described for use in a VSAT antenna system it is suitable for use in other satellite systems, such as ultra small antenna terminal (USAT) antenna system, geostationary satellite systems and terrestrial systems. In general, the slip joint polarizer is applicable to any linear polarity transmit/receive system.

By way of example, the antenna system shown and described includes an OMT as one of the two waveguides that are rotatably connected to one another. It is within the intended scope of the invention to replace the OMT with other waveguide components, such as co-polarity diplexers, single polarity receivers or transmitters, multiple side ports, multiple transmit only ports, receive only ports, and/or multiple combinations of transmit and receive side ports, all of which may include filters and/or LNBs.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A slip joint polarizer comprising:

a stationary waveguide;

a moveable waveguide connected to said stationary waveguide by a rotatable mating interface, said moveable waveguide being rotatable relative to said stationary waveguide to adjust receiving polarity;

a probe extending from said movable waveguide, passing through said mating interface and into said stationary waveguide; and a ridge launch attached to an inner surface of said moveable waveguide, wherein one end of said probe is secured to said ridge launch so that said probe rotates with said moveable waveguide, an opposite free end of said probe is disposed in said stationary waveguide.

2. A slip joint polarizer in accordance with claim 1, wherein said stationary waveguide is rectangular in shape.

3. A slip joint polarizer in accordance with claim 1, wherein said stationary waveguide is arranged substantially perpendicular relative to said moveable waveguide.

4. A slip joint polarizer in accordance with claim 1, wherein said rotatable mating interface is a pair of rotatable mating flanges with one flange of said pair disposed on said moveable waveguide and the other flange of said pair disposed on said stationary waveguide.

5. A slip joint polarizer in accordance with claim 4, wherein each flange has at least one channel defined therein for receiving a pin to secure said flanges together.

6. A slip joint polarizer in accordance with claim 1, wherein said moveable waveguide is rotated to adjust for at least one of receive and transmit polarity.

7. A slip joint polarizer comprising:

a stationary waveguide;

a moveable waveguide connected to said stationary waveguide by a rotatable mating interface, said moveable waveguide being rotatable relative to said stationary waveguide to adjust receiving polarity;

a probe extending from said movable waveguide, passing through said mating interface and into said stationary waveguide, and said probe is rotatable independent of rotation of said moveable waveguide so as to adjust transmit polarity.

8. A slip joint polarizer in accordance with claim 7, wherein a portion of said probe disposed in said moveable waveguide is bent.

9. A slip joint polarizer comprising:

a stationary waveguide;

an ortho mode transducer having a common port, a side port and a through port, said ortho mode transducer being rotatable relative to said waveguide to adjust at least one of receive and transmit polarity of said side and through ports;

a pair of rotatable mating flanges for connecting said through port to an aperture in a top wall of said stationary waveguide, and a probe extending from said ortho mode transducer, passing through said mating interface and into said stationary waveguide.

10. A slip joint polarizer in accordance with claim 9, wherein said stationary waveguide is rectangular in shape.

11. A slip joint polarizer in accordance with claim 9, wherein said stationary waveguide is arranged substantially perpendicular relative to said ortho mode transducer.

12. A slip joint polarizer in accordance with claim 9, wherein each flange has at least one aperture defined therein for receiving a pin to secure said flanges together.

13. A slip joint polarizer in accordance with claim 9, wherein one end of said probe is secured to an inner surface of said moveable waveguide via a ridge launch so that said probe rotates with said ortho mode transducer, an opposite free end of said probe is disposed in said stationary waveguide.

14. A slip joint polarizer in accordance with claim 9, wherein a portion of said probe disposed in said ortho mode transducer is bent.

15. A slip joint polarizer in accordance with claim 14, wherein said probe is fixedly connected to and rotates with said ortho mode transducer.

16. A slip joint polarizer in accordance with claim 14, wherein said probe is rotatable independent of rotation of said ortho mode transducer so as to adjust transmit polarity.

17. A slip joint polarizer in accordance with claim 9, wherein said ortho mode transducer is rotated to adjust for at least one of receive and transmit polarity.

18. A method for installing a slip joint polarizer comprising the steps of:

providing a slip joint polarizer including a stationary waveguide, a moveable waveguide connected via a rotatable mating interface to said stationary waveguide, and a probe extending from said moveable waveguide, through said mating interface and into said stationary waveguide, a ridge launch being attached to an inner surface of said moveable waveguide, wherein one end of said probe is secured to said ridge launch so that said probe rotates with said moveable waveguide, an opposite free end of said probe is disposed in said stationary waveguide;

rotating said moveable waveguide relative to said stationary waveguide to adjust at least one of receive and transmit polarity; and locking said moveable waveguide in position relative to said stationary waveguide.

19. A method in accordance with claim 18, wherein said mating interface comprises a pair of rotatable mating flanges with one flange of said pair disposed on said moveable waveguide and the other flange of said pair disposed on said stationary waveguide, each flange having at least one channel defined axially therethrough.

20. A method in accordance with claim 19, wherein said locking step comprises inserting a pin through aligned channels in each flange.

21. A method in accordance with claim 18, wherein said stationary waveguide is rectangular in shape.

22. A method in accordance with claim 18, wherein said stationary waveguide is arranged substantially perpendicular relative to said moveable waveguide.

23. A method in accordance with claim 18, wherein said moveable waveguide is an ortho mode transducer having a common port, a side port and a through port.

24. A method in accordance with claim 23, wherein said rotating step comprises rotating said ortho mode transducer to adjust at least one of receive and transmit polarity of said through and side ports.

25. A method for installing a slip joint polarizer comprising the steps of:

providing a slip joint polarizer including a stationary waveguide, a moveable waveguide connected via a rotatable mating interface to said stationary waveguide, and a probe extending from said moveable waveguide, through said mating interface and into said stationary waveguide;

rotating said moveable waveguide relative to said stationary waveguide to adjust at least one of receive and transmit polarity, said probe being rotatable independent of rotation of said moveable waveguide; and locking said moveable waveguide in position relative to said stationary waveguide.

26. A method in accordance with claim 25, wherein a portion of said probe disposed in said moveable waveguide is bent and said probe is rotatable independent of rotation of said moveable waveguide.

27. A method in accordance with claim 25, further comprising the step of rotating said probe to adjust transmit polarity.

28. A slip joint polarizer comprising:

a stationary waveguide;

a moveable waveguide connected to said stationary waveguide by a rotatable mating interface, said moveable waveguide being rotatable relative to said stationary waveguide to adjust receiving polarity, said moveable waveguide being an ortho mode transducer; and a probe extending from said movable waveguide, passing through said mating interface and into said stationary waveguide.

29. A method for installing a slip joint polarizer comprising the steps of:

providing a slip joint polarizer including a stationary waveguide, a moveable waveguide connected via a rotatable mating interface to said stationary waveguide, and a probe extending from said moveable waveguide, through said mating interface and into said stationary waveguide, said moveable waveguide being an ortho mode transducer;

rotating said moveable waveguide relative to said stationary waveguide to adjust at least one of receive and transmit polarity; and locking said moveable waveguide in position relative to said stationary waveguide.

* * * * *